US009297537B2

(12) United States Patent
Hensley et al.

(10) Patent No.: US 9,297,537 B2
(45) Date of Patent: Mar. 29, 2016

(54) ORIFICE HOLDER AND TUBE ASSEMBLY FOR USE WITH A GAS-FUELED APPLIANCE

(75) Inventors: Amelia Lear Hensley, Louisville, KY (US); Allen Louis Tatum, Flintstone, GA (US); Michael Mahaney, Lafayette, GA (US); Scott Russell King, Propect, KY (US); Jason Randall Northcut, Louisville, KY (US); Jeffrey Shawn Coulter, Ringgold, GA (US)

(73) Assignee: General Electric Company, Schenectady, NY (US)

( * ) Notice: Subject to any disclaimer, the term of this patent is extended or adjusted under 35 U.S.C. 154(b) by 1231 days.

(21) Appl. No.: 13/183,158

(22) Filed: Jul. 14, 2011

(65) Prior Publication Data

US 2013/0014744 A1 Jan. 17, 2013

(51) Int. Cl.

| | |
|---|---|
| ***F24C 3/00*** | (2006.01) |
| ***F24C 15/00*** | (2006.01) |
| ***F24C 3/12*** | (2006.01) |
| ***F24C 3/08*** | (2006.01) |
| ***F23D 14/06*** | (2006.01) |
| ***F23D 14/64*** | (2006.01) |
| ***F23D 23/00*** | (2006.01) |

(52) U.S. Cl.

CPC . *F24C 3/08* (2013.01); *F23D 14/06* (2013.01); *F23D 14/64* (2013.01); *F23D 23/00* (2013.01); *F23D 2213/00* (2013.01); *F23K 2900/05002* (2013.01); *F23N 2037/02* (2013.01)

(58) Field of Classification Search

CPC ..... F24C 3/08; F24C 3/122; F24C 3/124; F23D 14/06; F23D 14/64; F23D 23/00

USPC ..... 126/1 R, 39 E, 39 R; 137/98

See application file for complete search history.

(56) References Cited

U.S. PATENT DOCUMENTS 2,809,663 A * 10/1957 Farwick ..... 137/625.41
2010/0126495 A1 5/2010 Shaffer

FOREIGN PATENT DOCUMENTS

GB 819723 9/1959

* cited by examiner

*Primary Examiner* — William G Corboy
(74) *Attorney, Agent, or Firm* — Dority & Manning, P.A.

(57) ABSTRACT

An orifice holder for use with a gas-fueled appliance includes a body, an orifice passage defined in the body, a first tube passage defined in the body, and a second tube passage defined in the body. The orifice passage, the first tube passage, and the second tube passage are in flow communication within the body.

12 Claims, 6 Drawing Sheets

ORIFICE HOLDER AND TUBE ASSEMBLY FOR USE WITH A GAS-FUELED APPLIANCE

BACKGROUND OF THE INVENTION

The embodiments described herein relate generally to a tube assembly and, more particularly, to a tube assembly for use with a gas-fueled appliance.

At least some known gas-fueled cooktops include a pair of burners that can be used with a griddle, rather than grates. More specifically, the grates are removed and the griddle is positioned over the pair of burners. As such, both burners are activated to heat the entire griddle. One known cooktop includes valves that independently control each burner. When the griddle is used with the cooktop, each burner under the griddle is controlled independently. As such, it may be difficult to achieve uniform heating of the griddle.

Another known cooktop is configured to control the burners below the griddle as a unit. Such a cooktop includes three valves for the two burners. More specifically, a first valve independently controls a first burner, a second valve independently controls a second burner, and a third valve controls the first burner and the second burner as a unit. However, known cooktops do not control two burners as a unit because such cooktops include a one-to-one valve-to-burner ratio. Further, such a cooktop is connected to gas supplies using a separate component, and a single supply line is coupled between the component and an orifice holder of the burner.

BRIEF DESCRIPTION OF THE INVENTION

In one aspect, an orifice holder for use with a gas-fueled appliance is provided. The orifice holder includes a body, an orifice passage defined in the body, a first tube passage defined in the body, and a second tube passage defined in the body. The orifice passage, the first tube passage, and the second tube passage are in flow communication within the body.

In another aspect, a tube assembly for use with a gas-fueled appliance is provided. The tube assembly includes an orifice holder, a first tube coupled to the orifice holder, and a second tube coupled to the orifice holder. The orifice holder includes a body, an orifice passage defined in the body, a first tube passage defined in the body, and a second tube passage defined in the body. The first tube is coupled in flow communication with the first tube passage, and the second tube is coupled in flow communication with the second tube passage. The orifice passage, the first tube passage, and the second tube passage are in flow communication within the body.

In yet another aspect, a gas-fueled appliance is provided. The gas-fueled appliance includes a first burner and a tube assembly coupled to the first burner. The tube assembly includes an orifice holder, a first tube coupled to the orifice holder, and a second tube coupled to the orifice holder. The orifice holder includes a body, an orifice passage defined in the body, a first tube passage defined in the body, and a second tube passage defined in the body. The first tube is coupled in flow communication with the first tube passage, and the second tube is coupled in flow communication with the second tube passage. The orifice passage, the first tube passage, and the second tube passage are in flow communication within the body.

BRIEF DESCRIPTION OF THE DRAWINGS

FIG. 1 is a perspective view of an exemplary cooking appliance.

FIG. 2 is a schematic side view of the cooking appliance shown in FIG. 1.

FIG. 3 is a perspective view of an exemplary tube assembly that may be used with the cooking appliance shown in FIGS. 1 and 2.

FIG. 4 is a top view of the tube assembly shown in FIG. 3.

FIG. 5 is a first side view of the tube assembly shown in FIG. 3.

FIG. 6 is a second side view of the tube assembly shown in FIG. 3.

FIG. 7 is perspective view of the tube assembly shown in FIG. 3 in a bent configuration.

FIG. 8 is a cross-sectional view of an exemplary orifice holder that may be used with the tube assembly shown in FIGS. 3-6 taken at line 8-8 in FIG. 4.

FIG. 9 is a cross-sectional view of the orifice holder shown in FIGS. 3-8 taken at line 9-9 in FIG. 4.

FIG. 10 is a cross-sectional view of a portion of the orifice holder shown in FIG. 8.

DETAILED DESCRIPTION OF THE INVENTION

The embodiments described herein enable a gas-fueled cooking appliance to be operated in a normal mode and a griddle mode. As used herein, the "normal mode" refers to a mode in which each burner of the cooking appliance is operated independently, and the term "griddle mode" refers to a mode in which a plurality of burners are operated together as a unit. A griddle is not required during the griddle mode. Rather, a griddle is referred to herein for convenience. The herein-described embodiments enable one burner to be coupled to at least two different valves to operate in at least two different modes. However, one of the two valves is coupled to at least two burners to operate the burners simultaneously. As such, a user of the cooking appliance is provided with the same number of valve knobs and burners.

Further, the tube assembly described herein includes an orifice holder that is coupled to at least two gas supplies, without using another separate component between the gas supplies and the orifice holder. As such, the tube assembly eliminates components and reduces connections along the gas supply path.

Figure 1:
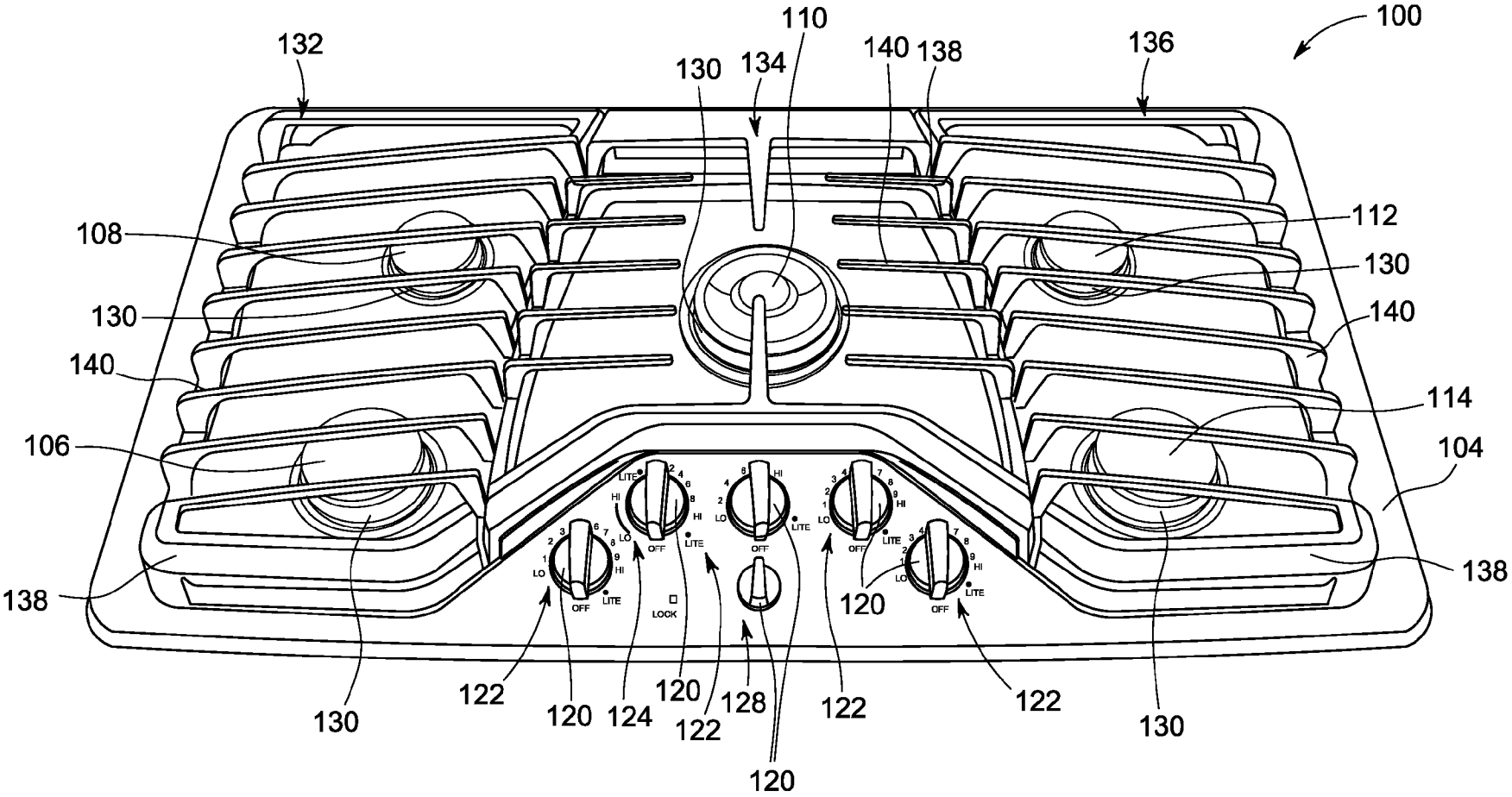
FIGS. 1-10 show exemplary embodiments of the apparatus and methods described herein.
Figure 2:
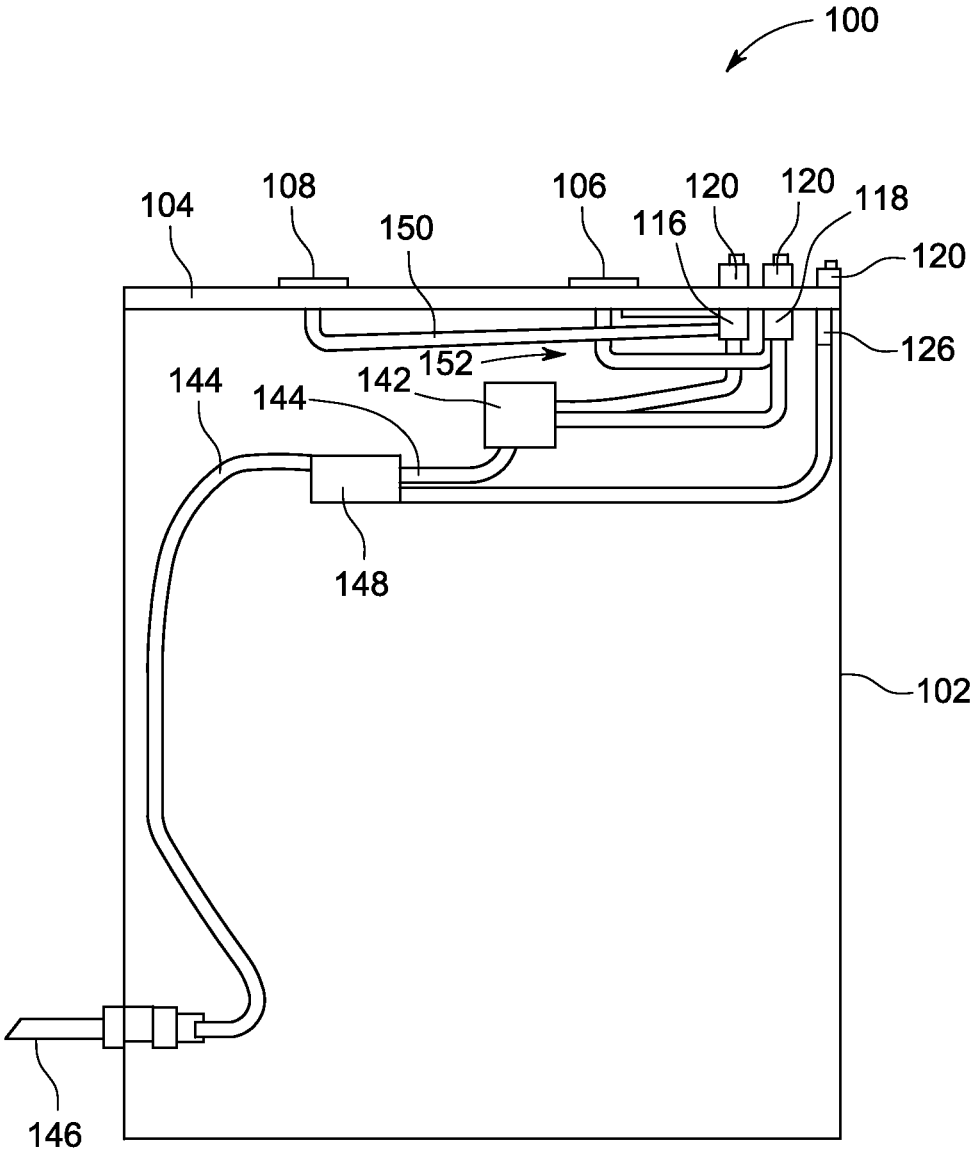

FIG. 1 is a perspective view of a gas cooking appliance, such as a cooktop 100, and FIG. 2 is a schematic side view of cooktop 100 supported by a support structure 102, such as a cabinet and/or countertop. It is contemplated that the embodiments described herein are applicable, not only to free-standing cooktops, but to other forms of cooktops, such as, but not limited to, cooktops that form an upper portion of a range having an oven and/or dual-fuel cooking appliances, (e.g., a gas cooktop with an electric oven), as well as other appliances that are gas-fueled. Therefore, cooktop 100 is provided by way of illustration rather than limitation, and accordingly there is no intention to limit application of the embodiments described herein to any particular appliance or cooktop, such as cooktop 100. In the exemplary embodiment, cooktop 100 uses natural gas or liquefied petroleum gas ("LP gas" or "propane gas") as fuel for burners thereof.

Cooktop 100 includes a plate 104 and a plurality of gas-fueled surface burners 106, 108, 110, 112, and 114. Burners 106, 108, 110, 112, and 114 are positioned in two spaced apart pairs of burners 106, 108 and 112, 114 positioned adjacent each side of cooktop 100 and a center burner 110 between the two pairs. Alternatively, cooktop 100 includes any suitable number and/or configuration of burners. In the exemplary embodiment, each burner 106, 108, 110, 112, and 114 is in flow communication with a respective gas valve 116 or 118, and a knob 120 is coupled to each gas valve 116 or 118 for operating a respective burner 106, 108, 110, 112, or 114. In the exemplary embodiment, cooktop 100 includes at least one specialty gas valve 116 and a plurality of normal gas valves, such as normal gas valve 118. Plate 104 includes indicia adjacent each knob 120 indicating the functionality of the respective knob 120. Plate 104 adjacent knob 120 of specialty gas valve 116 includes normal indicia 122 and griddle indicia 124. Plate 104 adjacent the normal gas valves includes normal indicia 122. Further, cooktop 100 includes a lock valve 126 having knob 120 and lock indicia 128 on plate 104 adjacent lock valve 126.

Each burner 106, 108, 110, 112, and 114 extends upwardly through an opening 130 in plate 104, and a removable grate assembly 132, 134, or 136 is positioned respectively over a first pair of burners 106 and 108, center burner 110, and a second pair of burners 112 and 114. Each grate assembly 132, 134, and 136 includes a frame 138 and separate supporting grates 140 are positioned above recessed areas of plate 104 and overlie burners 106, 108, 110, 112, and/or 114. Although burners 106 and 108 share grate assembly 132 and burners 112 and 114 share grate assembly 136, burner 106, 108, 112, and/or 114 includes an individual grate assembly.

Further, in the exemplary embodiment, grate assembly 132, 134, and/or 136 can be replaced by a griddle, grill, wok, and/or other suitable attachment for use with cooktop 100. For example, grate assembly 132 is replaceable with a griddle (not shown), and specialty gas valve 116 is coupled in flow communication with at least two burners, such as burners 106 and 108. In the exemplary embodiment, specialty gas valve 116 is configured to operate only burner 108 in a normal mode or operate burners 106 and 108 together in a griddle mode, as described in more detail below. In a particular embodiment, specialty gas valve 116 includes one gas input (not shown) and two gas outputs (not shown). Alternatively or additionally, the second pair of burners 112 and 114 includes specialty gas valve 116.

Burners 106, 108, 110, 112, and 114 are in selective flow communication with a manifold 142 via gas valves 116 and/or 118. A connector hose or supply line 144 is connected between a main supply line 146 and manifold 142, and a lockout valve assembly 148 is connected to or in line with manifold 142 along gas supply line 144. Lockout valve assembly 148 is in flow communication with, or included in, lock valve 126. In one embodiment, lockout valve assembly 148 regulates gas flow between main supply line 146 and manifold 142. In the exemplary embodiment, a tube 150 is in flow communication between each burner 110, 112, and 114 and a normal gas valve, tube 150 is in flow communication between burner 108 and specialty gas valve 116, and a tube assembly 152 is in flow communication between burner 106 and specialty gas valve 116 and normal gas valve 118.

Figure 3:
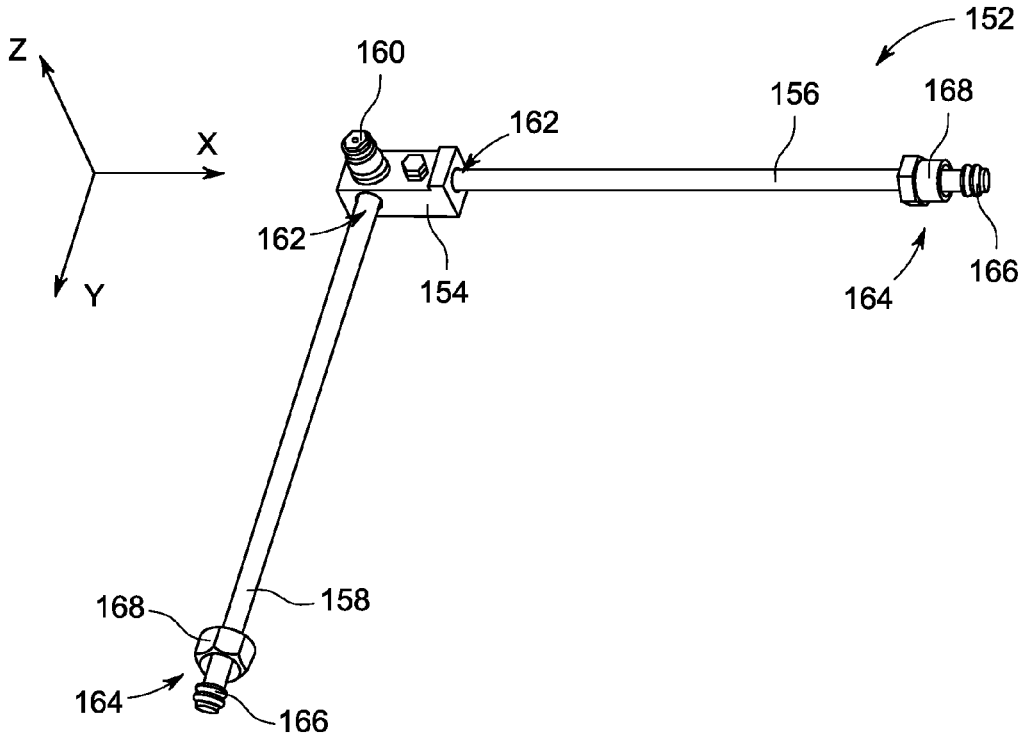
Figure 4:
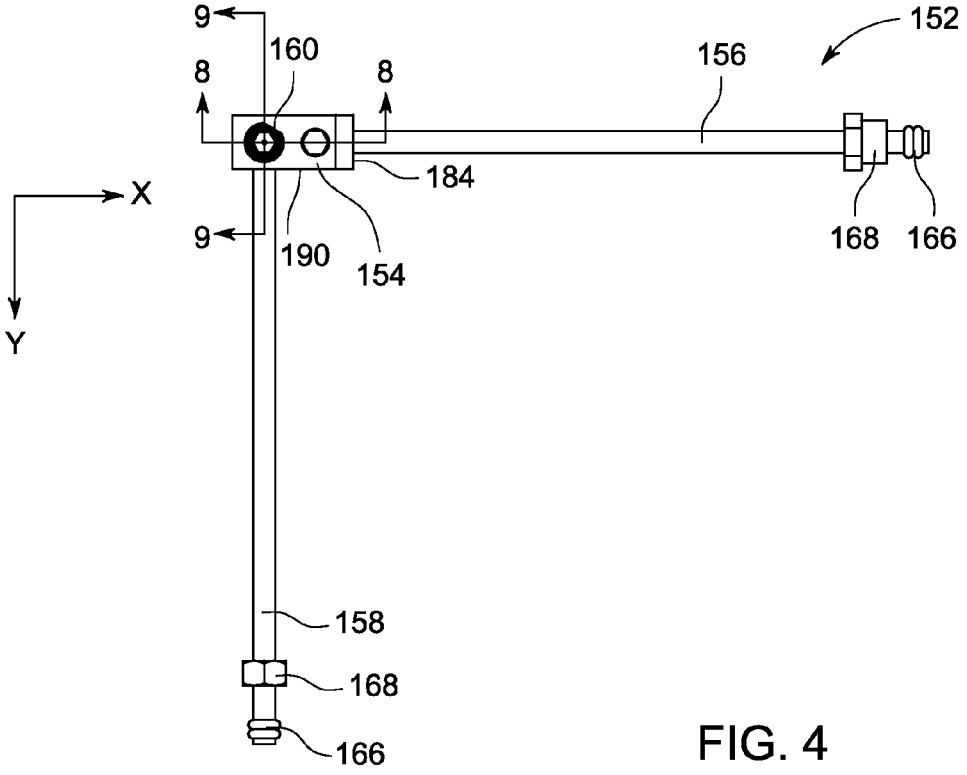
Figure 6:
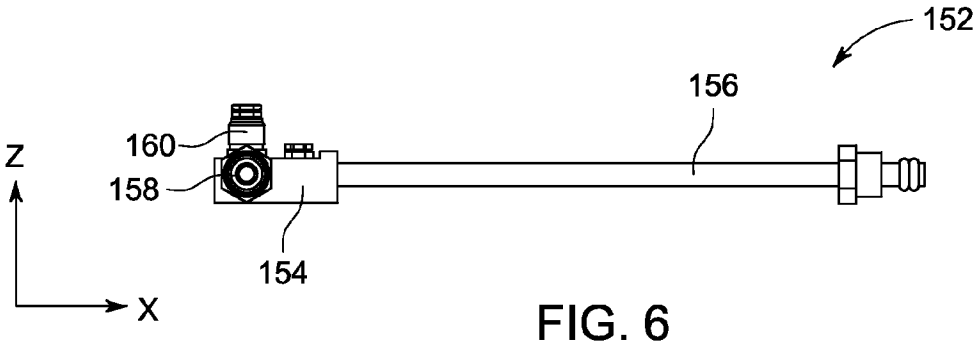
Figure 7:
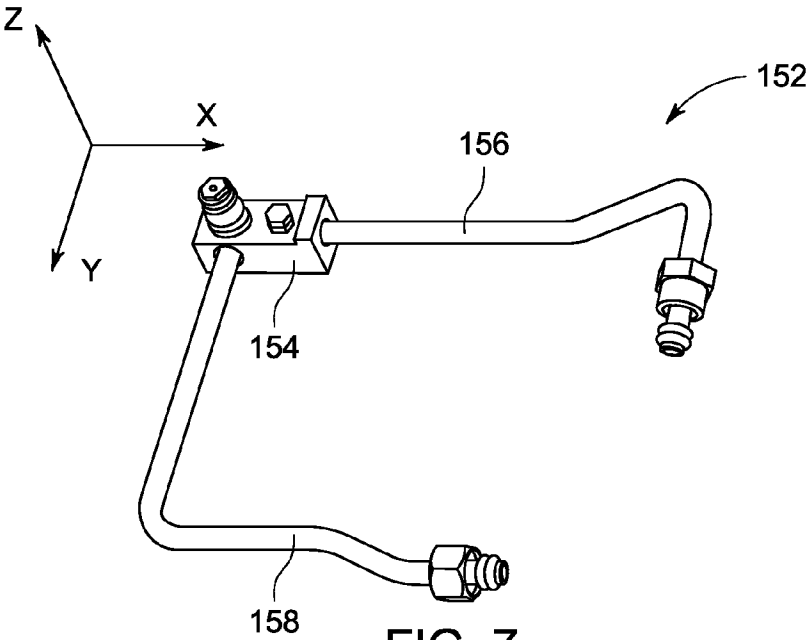
Figure 5:
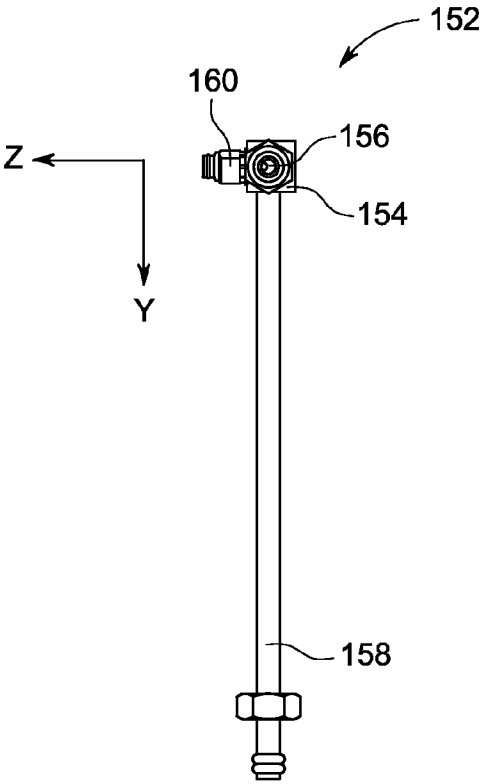

FIG. 3 is a perspective view of an exemplary tube assembly 152 that may be used with cooktop 100 (shown in FIGS. 1 and 2). FIG. 4 is a top view of tube assembly 152. FIG. 5 is a first side view of tube assembly 152. FIG. 6 is a second side view of tube assembly 152. FIG. 7 is perspective view of tube assembly 152 in a bent configuration. In the exemplary embodiment, tube assembly 152 is coupled to burner 106 (shown in FIGS. 1 and 2), specialty gas valve 116 (shown in FIG. 2), and normal gas valve 118 (shown in FIG. 2).

Tube assembly 152 includes an orifice holder 154, a first tube 156 coupled to orifice holder 154, and a second tube 158 coupled to orifice holder 154. Orifice holder 154 is configured to receive gas through first tube 156 or second tube 158 and discharge gas to burner 106 through a burner coupling 160. In one embodiment, orifice holder 154 is a block of material, such as metal material, and includes three connected passages defined therein, as described in more detail below with respect to FIGS. 8-10.

In a particular embodiment, gas is channeled through first tube 156 in the griddle mode and through second tube 158 in the normal mode. Each tube 156 and 158 includes a first end portion 162 configured to couple to orifice holder 154 and a second end portion 164 configured to couple to specialty gas valve 116 or normal gas valve 118. In a particular embodiment, first end portion 162 and second end portion 164 are staked into orifice holder 154. In the exemplary embodiment, each second end portion 164 includes a double bead 166 and a compression nut 168 to enable tubes 156 and 158 to couple in flow communication with to gas valve 116 and/or 118. Further, burner coupling 160 is configured to couple to burner 106, as described in more detail with respect to FIG. 11.

As shown in FIG. 7, first tube 156 can be bent to couple to an outlet (not shown) of specialty gas valve 116, and second tube 158 can be bent to couple to normal gas valve 118. However, for ease of manufacturing, tubes 156 and/or 158 are initially substantially straight and then configured to couple in flow communication with gas valve 116 and/or 118. Alternatively, tubes 156 and/or 158 can be configured to couple to gas valve 116 and/or 118 then coupled to orifice holder 154.

Figure 8:
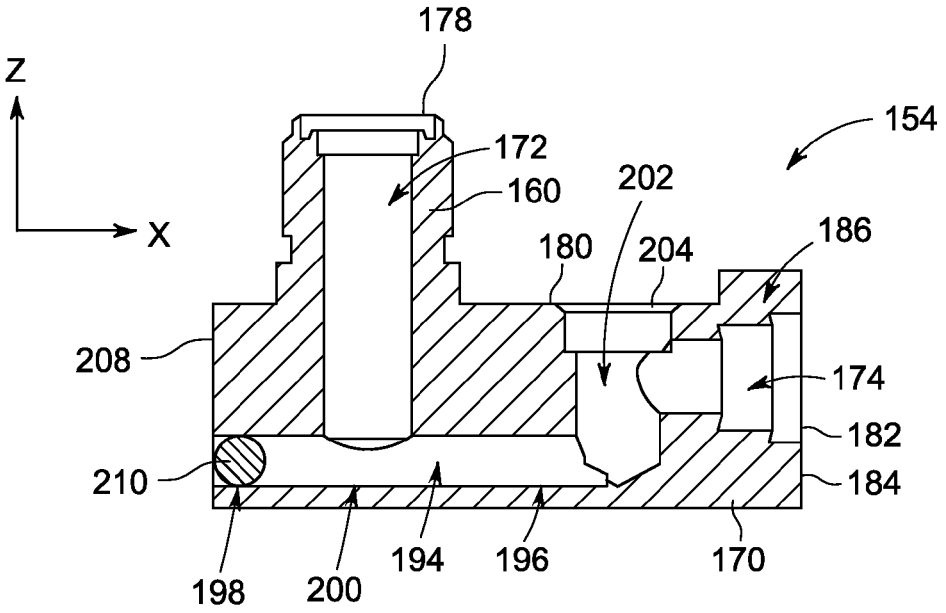
Figure 9:
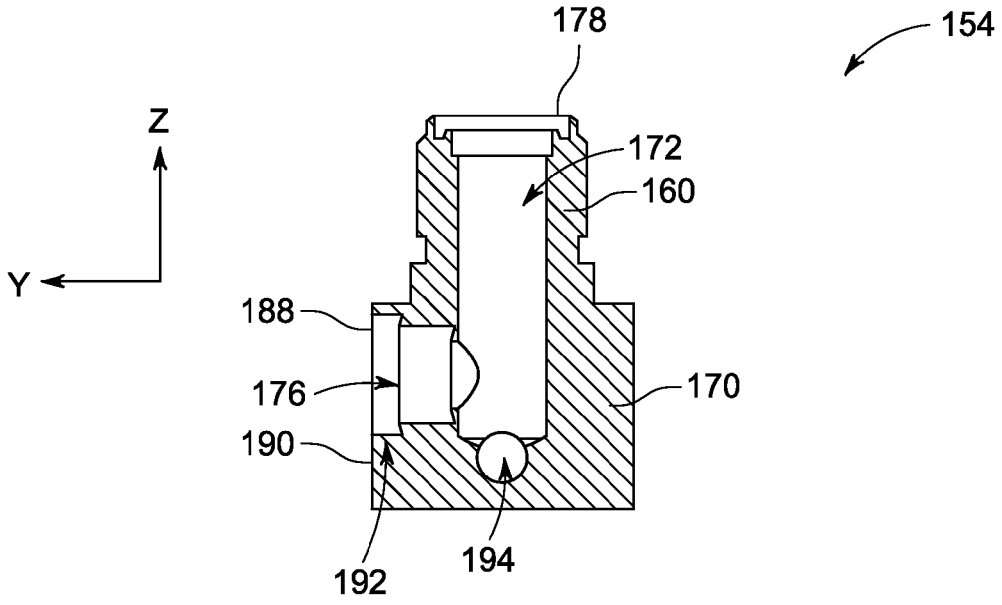

FIG. 8 is a cross-sectional view of exemplary orifice holder 154 that may be used with tube assembly 152 (shown in FIGS. 3-6) taken at line 8-8 in FIG. 4. FIG. 9 is a cross-sectional view of orifice holder 154 taken at line 9-9 in FIG. 4. Referring to FIGS. 4, 8, and 9, in the exemplary embodiment, orifice holder 154 includes a body 170 formed as one-piece of material, such as metal, to facilitate reducing fluid leaks from orifice holder 154. An orifice passage 172, a first tube passage 174, and a second tube passage 176 are defined in body 170. Orifice passage 172, first tube passage 174, and second tube passage 176 are connected in flow communication within body 170. Alternatively, first tube passage 174 and second tube passage 176 are in flow communication with orifice passage 172, but are not in flow communication with each other. When more than two valves are used to operate burner 106 (shown in FIGS. 1 and 2), orifice holder 154 includes more than two tube passages 174 and 176; however, it should be understood that all tube passages formed within body 170 are in flow communication with orifice passage 172.

Orifice passage 172 acts as a gas outlet from orifice holder 154 to burner 106 (shown in FIGS. 1 and 2). Orifice passage 172 is defined in a Z-direction through body 170 and forms an orifice opening 178 of orifice holder 154. More specifically, orifice passage 172 is defined in body 170 and extends through burner coupling 160. In the exemplary embodiment, burner coupling 160 is formed integrally as one-piece with body 170 and extends from an upper face 180 of body 170 in the Z-direction. Alternatively, burner coupling 160 is oriented at any suitable angle with respect to upper face 180 of body 170. In the exemplary embodiment, burner coupling 160 is configured to couple orifice holder 154 to burner 106 such that burner 106 is coupled in flow communication with orifice passage 172, as described in more detail with respect to FIG. 11.

First tube passage 174 acts as a first gas inlet from specialty gas valve 116 (shown in FIG. 2) to orifice holder 154. First tube passage 174 is defined in an X-direction through body 170 and forms a first tube opening 182 in a first side face 184 of body 170. Alternatively, first tube passage 174 is defined through any suitable portion and/or face of body 170 that enables first tube passage 174 to be in flow communication with orifice passage 172 and second tube passage 176. In the exemplary embodiment, first tube passage 174 includes a coupling portion 186 that enables first tube passage 174 to be coupled in flow communication with specialty gas valve 116 via first tube 156. More specifically, coupling portion 186 is configured to receive a portion of first tube 156 therein to couple first tube 156 to orifice holder 154. When tube assembly 152 is assembled, first tube 156 is inserted through first tube opening 182 into coupling portion 186 to be coupled in flow communication with first tube passage 174.

Second tube passage 176 acts as a second gas inlet from normal gas valve 118 (shown in FIG. 2) to orifice holder 154. Second tube passage 176 is defined in a Y-direction through body 170 and forms a second tube opening 188 in an end face 190 of body 170. Alternatively, second tube passage 176 is defined through any suitable portion and/or face of body 170 that enables second tube passage 176 to be in flow communication with orifice passage 172 and first tube passage 174. In the exemplary embodiment, second tube passage 176 includes a coupling portion 192 that enables second tube passage 176 to be coupled in flow communication with normal gas valve 118 via second tube 158. More specifically, coupling portion 192 is configured to receive a portion of second tube 158 therein to couple second tube 158 to orifice holder 154. When tube assembly 152 is assembled, second tube 158 is inserted through second tube opening 188 into coupling portion 192 to be coupled in flow communication with second tube passage 176.

A connecting passage 194 is defined within body 170 to couple orifice passage 172, first tube passage 174, and second tube passage 176 in flow communication with each other. In the exemplary embodiment, connecting passage 194 includes a first end portion 196, a second end portion 198, and a middle portion 200 extending between first end portion 196 and second end portion 198. First end portion 196 is in flow communication with first tube passage 174, and orifice passage 172 and second tube passage 176 extend from middle portion 200. More specifically, connecting passage 194 extends through body 170 in the X-direction, and orifice passage 172 and second tube passage 176 extend from connecting passage through upper face 180 and end face 190, respectively. Alternatively, connecting passage 194 can have any suitable orientation, size, and/or configuration that enables orifice passage 172, first tube passage 174, and second tube passage 176 to be in flow communication with each other. In an alternative embodiment, connecting passage 194 is omitted, and orifice passage 172 is directly in flow communication with first tube passage 174 and second tube passage 176.

In the exemplary embodiment, a set screw passage 202 is defined between first end portion 196 of connecting passage 194 and first tube passage 174. As such, first tube passage 174 is in flow communication with connecting passage 194 via set screw passage 202. Set screw passage 202 is defined through body 170 in the Z-direction and forms a screw opening 204 in upper face 180 of body 170. Set screw passage 202 is configured have a set screw 206 (shown in FIG. 10) coupled therein. Alternatively, set screw passage 202 is omitted and first tube passage 174 is directly in flow communication with connecting passage 194, orifice passage 172, and/or second tube passage 176.

In the exemplary embodiment, orifice passage 172, first tube passage 174, second tube passage 176, connecting passage 194, and set screw passage 202 are drilled into body 170 through a respective face of body 170. As such, connecting passage 194 is defined in body 170 through a second side face 208 of body 170. To prevent a fluid flow from first tube passage 174 and/or second tube passage 176 from being discharged from orifice holder 154 other than through orifice passage 172, second end portion 198 of connecting passage 194 includes a seal 210 coupled therein. More specifically, a metal ball is used as seal 210 and is inserted into second end portion 198 to seal connecting passage 194. The metal ball is then coupled to body 170 by, for example, welding, gluing, and/or any other suitable coupling technique that forms a fluid tight seal. If orifice holder 154 is manufactured other than by drilling passages 172, 174, 176, 194, and/or 202 into body 170, seal 210 can be omitted.

Figure 10:
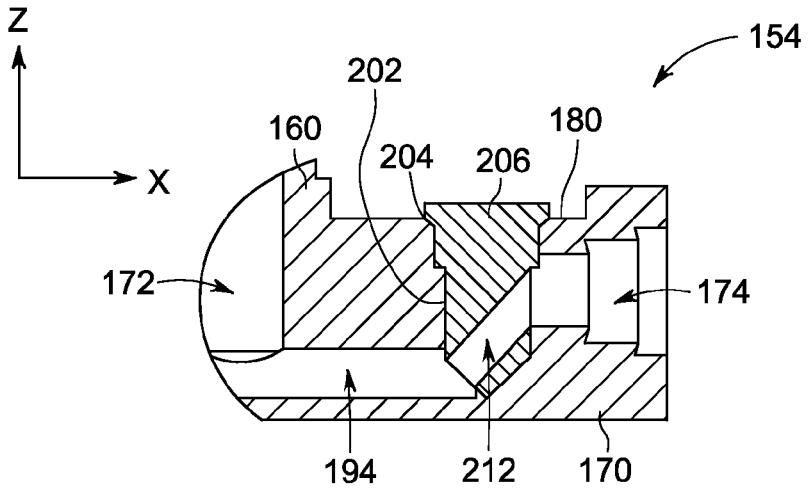

FIG. 10 is a cross-sectional view of a portion of orifice holder 154 including set screw 206 coupled within set screw passage 202. Set screw 206 is configured to control a fluid flow from first tube passage 174 to orifice passage 172 and/or burner 106 (shown in FIGS. 1 and 2). More specifically, set screw 206 includes a passage 212 defined therethrough to enable a fluid flow through set screw 206. A size and/or configuration of passage 212 depends on a type of gaseous fuel that is used with cooktop 100 (shown in FIGS. 1 and 2). For example, passage 212 is smaller when LP gas is used as the fuel for cooktop 100, and passage 212 is larger when natural gas is used as the fuel for cooktop 100. Cooktop 100 and/or tube assembly 152 can be provided within a plurality of different set screws each corresponding to a type of gaseous fuel. As such, when cooktop 100 and/or tube assembly 152 is installed, an installer can select the appropriate set screw 206 and couple set screw 206 within set screw passage 202. Once set screw 206 is installed in orifice holder 154, set screw 206 does not need to be removed; however, because screw opening 204 is on upper face 180 of body 170, set screw 206 is relatively easily accessible to a user.

As an alternative to set screw 206 and set screw passage 202, different orifice holders 154 each having different sized and/or configured passages 172, 174, 176, 194, and/or 202 can be manufactured. A consumer and/or installer can then select the type of orifice holder that is appropriate for use with cooktop 100, depending on the type of gaseous fuel, and install the appropriate orifice holder 154 in cooktop 100.

Figure 11:
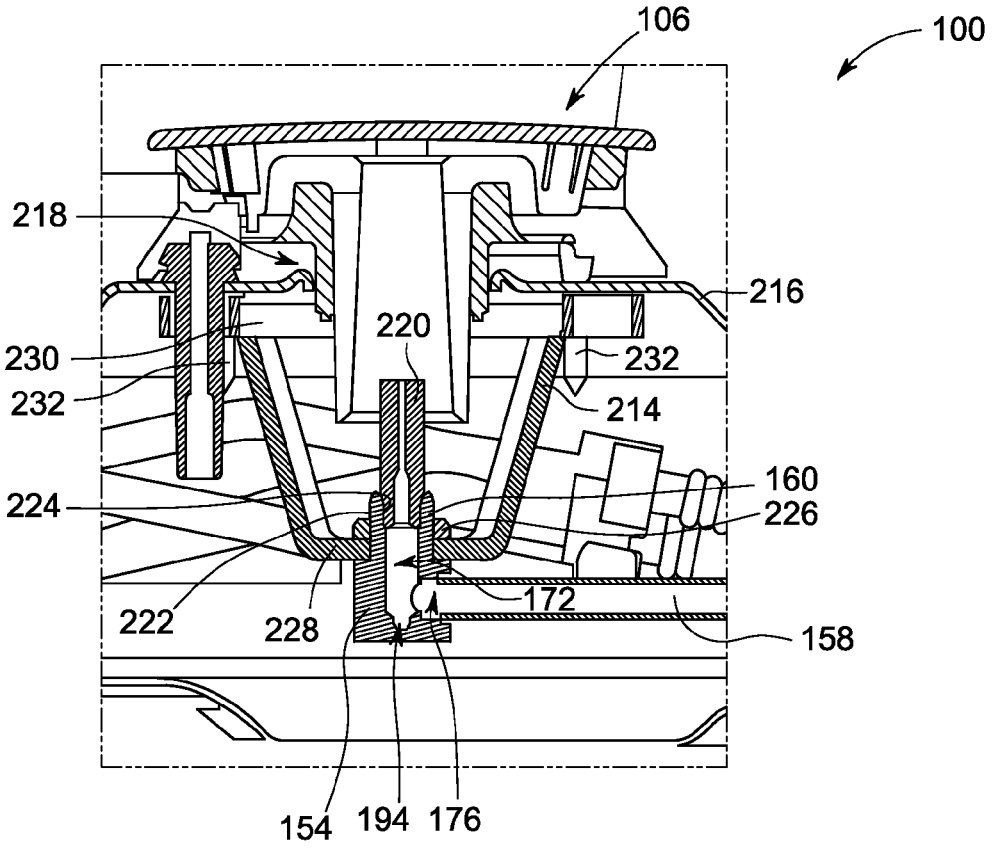
FIG. 11 is a cross-sectional view of the orifice holder shown in FIGS. 8-10 coupled to a burner.

FIG. 11 is a cross-sectional view of orifice holder 154 coupled to burner 106. More specifically, a bracket 214 attaches orifice holder 154 to a maintop 216 of cooktop 100. Burner 106 is inserted though an opening 218 in maintop 216 and coupled to orifice holder 154 via an orifice 220. In the exemplary embodiment, burner coupling 160 is threaded on an exterior surface 222 and an interior surface 224 thereof. Bracket 214 is coupled to burner coupling 160 using a nut 226 threaded onto burner coupling 160. A bottom portion 228 of bracket 214 is secured between orifice holder 154 and nut 226. An upper portion 230 of bracket 214 is coupled to maintop 216 using screws 232 and/or any other suitable coupling mechanism. A threaded orifice 220 is coupled to burner coupling 160 at threads of interior surface 224. Burner 106 rests about orifice 220. Gas is discharged from orifice holder 154 through orifice 220 and into burner 106, at which combustion occurs.

Referring to FIGS. 1-10, a user selects whether to operate cooktop 100 in a normal mode or a griddle mode. When operating in the normal mode, burner 106 is operated using normal gas valve 118, and burner 108 is operated using specialty gas valve 116 within a range of normal indicia 122. More specifically, each valve 116 and/or 118 is rotated counter-clockwise to a selected heat setting indicated by normal indicia 122 to operate burner 108 and/or 106, respectively. Normal gas valve 118 channels gas through second tube 158 to burner 106 via orifice holder 154, and specialty gas valve 116 channels gas though tube 150 to burner 108.

To operate cooktop 100 in the griddle mode, normal gas valve 118 is set to an off position, and specialty gas valve 116 is rotated counter-clockwise through normal indicia 122 to griddle indicia 124. Once specialty gas valve 116 is rotated into griddle indicia 124, specialty gas valve 116 channels gas through first tube 156 to burner 106 via orifice holder 154 and through tube 150 to burner 108 simultaneously. Normal gas valve 118 blocks second tube 158 to prevent gas from being discharged from orifice holder 154 though second tube 158.

The above-described embodiments allow at least two burners to be controlled simultaneously using a common valve. As such, even heating between the at least two burners can be achieved. Further, the above-described orifice holder is formed as a single piece to facilitate reducing leaks. Moreover, the orifice holder channels gas from at least two gas sources to a single orifice outlet to reduce the number of orifice outlets connected to an orifice holder of a burner.

Exemplary embodiments of an orifice holder and a tube assembly for use with a gas-fueled appliance are described above in detail. The apparatus and methods are not limited to the specific embodiments described herein, but rather, components of apparatus and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An orifice holder for use with a gas-fueled appliance, said orifice holder comprising:

a body;

an orifice passage defined in said body;

a first tube passage defined in said body;

a second tube passage defined in said body, wherein said orifice passage, said first tube passage, and said second tube passage are in flow communication within said body; and a connecting passage defined within said body, said connecting passage couples said orifice passage, said first tube passage, and said second tube in flow communication, wherein, the orifice holder further comprises a set screw passage defined between a first end of said connecting passage and said first tube passage, said set screw passage being orthogonal to said first tube passage, and said set screw passage is configured to receive a set screw for controlling a fluid flow from said first tube passage to said orifice passage, wherein a second end of said connecting passage comprises a seal.

2. An orifice holder in accordance with claim 1 further comprising a burner coupling formed integrally with said body, said orifice passage defined through said burner coupling.

3. An orifice holder in accordance with claim 1, wherein said connecting passage comprises a middle portion extending between said first end and said second end, said first end in flow communication with said first tube passage, and said orifice passage and said second tube passage extending from said middle portion.

4. An orifice holder in accordance with claim 1, wherein said first tube passage is configured to be coupled in flow communication with a first valve and said second tube passage is configured to be coupled in flow communication with a second valve.

5. A tube assembly for use with a gas-fueled appliance, said tube assembly comprising:

an orifice holder;

a first tube coupled to said orifice holder; and a second tube coupled to said orifice holder, wherein said orifice holder comprises:

a body;

an orifice passage defined in said body;

a first tube passage defined in said body, said first tube coupled in flow communication with said first tube passage;

a second tube passage defined in said body, said second tube coupled in flow communication with said second tube passage wherein said orifice passage, said first tube passage, and said second tube passage are in flow communication within said body; and a connecting passage defined within said body, said connecting passage couples said orifice passage, said first tube passage, and said second tube in flow communication, wherein, the orifice holder further comprises a set screw passage defined between a first end of said connecting passage and said first tube passage, said set screw passage being orthogonal to said first tube passage, and said set screw passage is configured to receive a set screw for controlling a fluid flow from said first tube passage to said orifice passage, wherein a second end of said connecting passage comprises a seal.

6. A tube assembly in accordance with claim 5, wherein said first tube passage is configured to receive a portion of said first tube therein and said second tube passage is configured to receive a portion of said second tube therein.

7. A tube assembly in accordance with claim 5, wherein said orifice body further comprises a burner coupling formed integrally with said body, said orifice passage defined through said burner coupling.

8. A gas-fueled appliance comprising:

a first burner; and a tube assembly coupled to said first burner, said tube assembly comprising an orifice holder, a first tube coupled to said orifice holder, and a second tube coupled to said orifice holder, wherein said orifice holder comprises:

a body;

an orifice passage defined in said body;

a first tube passage defined in said body, said first tube coupled in flow communication with said first tube passage;

a second tube passage defined in said body, said second tube coupled in flow communication with said second tube passage, wherein said orifice passage, said first tube passage, and said second tube passage are in flow communication within said body; and a connecting passage defined within said body, said connecting passage couples said orifice passage, said first tube passage, and said second tube in flow communication, wherein, the orifice holder further comprises a set screw passage defined between a first end of said connecting passage and said first tube passage, said set screw passage being orthogonal to said first tube passage, and said set screw passage is configured to receive a set screw for controlling a fluid flow from said first tube passage to said orifice passage, wherein a second end of said connecting passage comprises a seal.

9. A gas-fueled appliance in accordance with claim 8, wherein said first burner is coupled in flow communication with said orifice passage.

10. A gas-fueled appliance in accordance with claim 8 further comprising:

a first valve coupled in flow communication with said first tube; and a second valve coupled in flow communication with said second tube.

11. A gas-fueled appliance in accordance with claim 10, wherein said first valve is configured to channel gas to said orifice holder and to a second burner in a griddle mode, said second valve is configured to block said second tube in the griddle mode when in an off position.

12. A gas-fueled appliance in accordance with claim 8, wherein said orifice holder further comprises a burner coupling formed integrally with said body and configured to couple said orifice holder to said first burner, said orifice passage defined through said burner coupling.

* * * * *